US008540931B2

(12) United States Patent
Aichinger et al.

(10) Patent No.: US 8,540,931 B2
(45) Date of Patent: Sep. 24, 2013

(54) NOZZLE FOR INJECTING GAS CONTAINING OXYGEN INTO A PIG IRON DEVICE HAVING AN INJECTOR INSERTION PIPE

(75) Inventors: Georg Aichinger, Asten (AT); Franz Berner, Asten (AT); Stefan Lechner, Leonding (AT); Marinko Lekic-Ninic, Linz (AT); Jan-Friedemann Plaul, Linz (AT); Johannes Leopold Schenk, Linz (AT); Martin Schmidt, Leonding (AT); Thomas Söntgen, Hamminkeln (DE); Bogdan Vuletic, Düsseldorf (DE); Kurt Wieder, Schwertberg (AT); Johann Wurm, Bad Zell (AT)

(73) Assignees: Siemens Vai Metals Technologies GmbH, Linz (AT); Siemens Aktiengesellschaft, Munich (DE)

( * ) Notice: Subject to any disclaimer, the term of this patent is extended or adjusted under 35 U.S.C. 154(b) by 52 days.

(21) Appl. No.: 13/131,761

(22) PCT Filed: Nov. 5, 2009

(86) PCT No.: PCT/EP2009/064685

§ 371 (c)(1),
(2), (4) Date: Aug. 22, 2011

(87) PCT Pub. No.: WO2010/060770

PCT Pub. Date: Jun. 3, 2010

(65) Prior Publication Data

US 2011/0290075 A1 Dec. 1, 2011

(30) Foreign Application Priority Data

Nov. 28, 2008 (AT) ..... A 1863/2008

(51) Int. Cl.
*C21B 11/08* (2006.01)

(52) U.S. Cl.
USPC ..... 266/269; 266/217; 266/270

(58) Field of Classification Search
USPC ..... 266/217, 268, 269, 270
See application file for complete search history.

(56) References Cited

U.S. PATENT DOCUMENTS 3,811,386 A * 5/1974 Knuppel et al. ..... 266/222
3,898,078 A 8/1975 Huber ..... 75/60

(Continued)

FOREIGN PATENT DOCUMENTS

DE 102005032444 A1 1/2007
EP 0625685 A1 11/1994

(Continued)

OTHER PUBLICATIONS

International PCT Search Report, PCT/EP2009/064685, 3 pages, Mailed Jan. 21, 2010.

*Primary Examiner* — Scott Kastler
(74) *Attorney, Agent, or Firm* — King & Spalding L.L.P.

(57) ABSTRACT

An injector insert pipe is arranged in the gas channel of a nozzle for injecting oxygen-containing gas into a pig iron production unit, wherein an interspace which surrounds the pipe is present over the entire pipe length between the wall of the gas channel and the pipe outer wall. The pipe extends at least as far as the nozzle end face which contains the mouth of the gas channel. The pipe space is connected to an oxygen-containing gas feed line, and the interspace is connected to a protective gas supply line. In a process, oxygen-containing gas is fed into the pipe space, which after it has flowed through the pipe, enters the production unit at an entry velocity, and the interspace is simultaneously flowed through by a gas which exits into the production unit at an exit velocity, wherein the entry velocity is greater than the exit velocity.

5 Claims, 4 Drawing Sheets

(56) References Cited

U.S. PATENT DOCUMENTS

| | | | | |
|---|---|---|---|---|
| 4,434,976 | A | 3/1984 | Murakami et al. | 266/268 |
| 5,902,372 | A * | 5/1999 | Ramaseder et al. | 75/10.4 |
| 2007/0290418 | A1 | 12/2007 | Corbett et al. | 266/186 |
| 2011/0290075 | A1 | 12/2011 | Aichinger et al. | 75/392 |

FOREIGN PATENT DOCUMENTS

| | | | |
|---|---|---|---|
| KR | 20030030495 | A | 4/2003 |
| WO | 2005/116275 | A2 | 12/2005 |
| WO | 2007/133050 | A1 | 11/2007 |
| WO | 2010/060770 | A1 | 6/2010 |

* cited by examiner

NOZZLE FOR INJECTING GAS CONTAINING OXYGEN INTO A PIG IRON DEVICE HAVING AN INJECTOR INSERTION PIPE

CROSS-REFERENCE TO RELATED APPLICATIONS

This application is a U.S. National Stage Application of International Application No. PCT/EP2009/064685 filed Nov. 5, 2009, which designates the United States of America, and claims priority to Austrian Application No. A1863/2008 filed Nov. 28, 2008, the contents of which are hereby incorporated by reference in their entirety.

TECHNICAL FIELD

The invention relates to a nozzle, which is preferably produced from copper or a copper alloy, for injecting oxygen-containing gas into a pig iron production unit, wherein the nozzle is provided with an injector insert pipe.

BACKGROUND

Oxygen or oxygen-containing gas is injected into pig iron production units, in which carbon carriers are used to reduce iron-oxide-containing material to pig iron, in order to produce reducing gas and to provide heat required for the ongoing chemical and physical conversions by means of exothermic oxidation processes. For easier legibility, the terms "oxygen" and "oxygen-containing gas" are used as synonyms in the text which follows. Those parts of the devices for injecting oxygen which adjoin the reaction chamber of the pig iron production unit are exposed to high temperatures, and this makes it necessary to cool these parts intensively. In order to achieve particularly good heat dissipation during cooling, the nozzles for injecting oxygen are produced from copper or a copper alloy.

The problem which arises during operation of the pig iron production unit is that media are sucked up from the reaction chamber into the jet of oxygen at the high velocities at which oxygen is blown in, i.e. between 70 and 330 m/s. By way of example, these media are hot gases, particles of solid matter or particles of liquid matter such as molten iron or molten slag. The effect of the suction is that these media flow back counter to the flowing-out direction of the oxygen as far as the outlet edge of the oxygen channel of the nozzle. It has been shown that this results in hot gases and particles of solid matter and liquid matter being sucked into the oxygen channel, which leads to deposits in the oxygen channel and to thermal-abrasive wear of the nozzle. Hot gases which enter the oxygen channel lead to the build-up of resistance to the direction of oxygen flow, to heating of the oxygen, and therefore to thermal loading of the nozzle and thermally induced wear.

The advantage of using copper or a copper alloy as the nozzle material is that it can be effectively cooled owing to its thermal conductivity, but this also has the disadvantage that it can provide little resistance to thermal-abrasive wear owing to its strength. The wear has a negative effect in many ways. Firstly, it is necessary to exchange worn nozzles for maintenance, which means operational stoppages and therefore a drop in production. In addition, the reaction behavior in the pig iron production unit changes since the jet of oxygen penetrates to different extents into the reaction chamber given different shapes of the outlet edge; it becomes more difficult to plan production over a relatively long period of time due to fluctuations in the reducing time which are associated with wear of the outlet edge. In addition, the wear bears a considerable safety risk, since the nozzle is cooled with water. If the wear produces a leak in the cooling water channel, water may enter the reaction chamber and cause explosions.

SUMMARY

According to various embodiments, a nozzle can be specified, which is preferably produced from copper or a copper alloy, for injecting oxygen-containing gas into a pig iron production unit, in which the wear of the nozzle is reduced and this nozzle is simple to produce and maintain.

According to various embodiments, a nozzle for injecting oxygen-containing gas into a pig iron production unit, may have at least one gas channel, wherein an injector insert pipe, which can preferably be inserted into the gas channel of the nozzle in exchangeable fashion, is arranged in the gas channel of the nozzle in such a way that an interspace which surrounds the injector insert pipe is present over the entire length of the injector insert pipe between the wall of the gas channel and the outer wall of the injector insert pipe, wherein the injector insert pipe is provided with spacers which support said pipe, when it has been inserted, on the wall of the gas channel, wherein the injector insert pipe is produced from refractory material, wherein the injector insert pipe extends at least as far as the end face of the nozzle which contains the mouth of the gas channel, wherein the space surrounded by the injector insert pipe is connected to a feed line for oxygen-containing gas, and wherein the interspace between the wall of the gas channel and the outer wall of the injector insert pipe is connected to a supply line for protective gas or to a supply line for oxygen-containing gas.

According to a further embodiment, the pig iron production unit can be a melter gasifier. According to a further embodiment, the refractory material can be aluminum oxide $Al_2O_3$, zirconium dioxide $ZrO_2$, magnesium oxide MgO, non-oxidic ceramic fiber composite materials, oxidic ceramic fiber composite materials or high-temperature-resistant steels. According to a further embodiment, the injector insert pipe may extend beyond the end face of the nozzle which contains the mouth of the gas channel.

5) The nozzle as claimed in one of the preceding claims, characterized in that the gas channel is provided, in the region of the mouth, with one or more insert pieces which are made from refractory material and extend at least as far as the end face of the nozzle which contains the mouth of the oxygen channel. According to a further embodiment, the end face of the nozzle which may contain the mouth of the gas channel is provided with one or more insert pieces made from refractory material, wherein the outlet edge of the mouth is completely covered.

According to another embodiment, an injector insert pipe for a nozzle for injecting oxygen-containing gas into a pig iron production unit, wherein the injector insert pipe can be inserted into a gas channel of the nozzle in exchangeable fashion, can be produced from refractory material, and the injector insert pipe, when it has been inserted, extends at least as far as the end face of the nozzle which contains the mouth of the gas channel, and the injector insert pipe can be provided with spacers which support said pipe, when it has been inserted, on the wall of the gas channel.

According to a further embodiment of the injector insert pipe, the pig iron production unit can be a melter gasifier. According to a further embodiment of the injector insert pipe, the refractory material can be aluminum oxide $Al_2O_3$, zirconium dioxide $ZrO_2$, magnesium oxide MgO, non-oxidic ceramic fiber composite materials, oxidic ceramic fiber composite materials or high-temperature-resistant steels. According to a further embodiment of the injector insert pipe, the injector insert pipe, when it has been inserted, may extend beyond the end face of the nozzle which contains the mouth of the gas channel.

According to yet another embodiment, a nozzle as described above can be used in the production of pig iron.

According to yet other embodiments an injector insert pipe as described above can be used in the production of pig iron.

According to further embodiments, the above use can be in the production of pig iron in a melter gasifier.

According to yet another embodiment, in a process for injecting oxygen-containing gas from a nozzle, which has at least one gas channel, into a pig iron production unit, oxygen-containing gas is fed into a space which is surrounded by the inner wall of an injector insert pipe may be inserted into the gas channel of the nozzle in exchangeable fashion, and the oxygen-containing gas, after it has flowed through the injector insert pipe, enters the pig iron production unit at an oxygen gas entry velocity, and an interspace which is present between the outer wall of the injector insert pipe and the wall of the gas channel is simultaneously flowed through by a gas which, after it has flowed through the interspace, exits into the pig iron production unit at a gas exit velocity, wherein the oxygen gas entry velocity is greater than the gas exit velocity.

According to a further embodiment of the above process, the gas which flows through the interspace between the outer wall of the injector insert pipe and the wall of the gas channel can be protective gas or oxygen-containing gas.

BRIEF DESCRIPTION OF THE DRAWINGS

In the text which follows, the present invention will be explained with reference to the schematic, exemplary figures.

DETAILED DESCRIPTION

Figure 1:
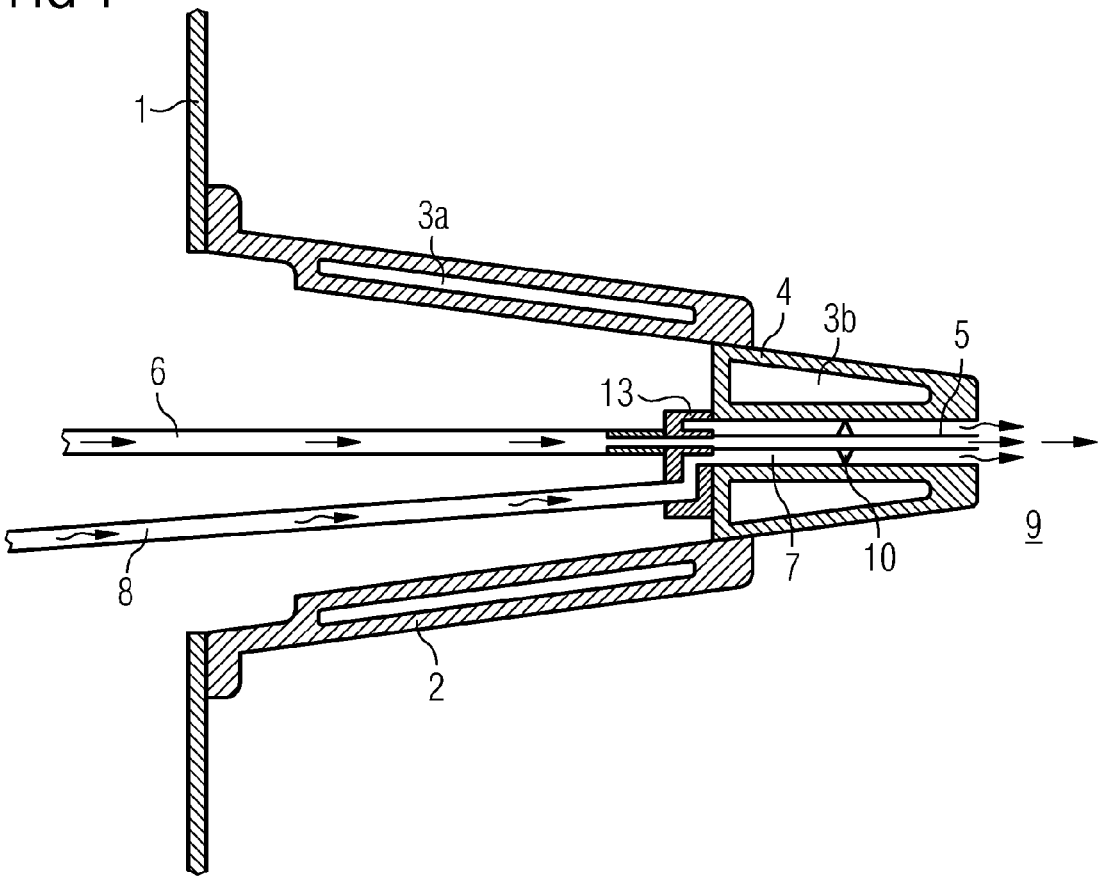
FIG. 1 shows a longitudinal section of an excerpt of a region of the wall of a pig iron production unit with a nozzle.

This object is achieved by a nozzle for injecting oxygen-containing gas into a pig iron production unit, wherein the nozzle has at least one gas channel, wherein the nozzle is characterized in that an injector insert pipe, which can preferably be inserted into the gas channel of the nozzle in exchangeable fashion, is arranged in the gas channel of the nozzle in such a way that an interspace which surrounds the injector insert pipe is present over the entire length of the injector insert pipe between the wall of the gas channel and the outer wall of the injector insert pipe, wherein the injector insert pipe is provided with spacers which support said pipe, when it has been inserted, on the wall of the gas channel, the injector insert pipe is produced from refractory material, the injector insert pipe extends at least as far as the end face of the nozzle which contains the mouth of the gas channel, and the space surrounded by the injector insert pipe is connected to a feed line for oxygen-containing gas, and the interspace between the wall of the gas channel and the outer wall of the injector insert pipe is connected to a supply line for protective gas or to a supply line for oxygen-containing gas.

The process, according to various embodiments, for injecting oxygen-containing gas from a nozzle, which has at least one gas channel, into a pig iron production unit is characterized in that oxygen-containing gas is fed into a space which is surrounded by the inner wall of an injector insert pipe inserted into the gas channel of the nozzle in exchangeable fashion, and the oxygen-containing gas, after it has flowed through the injector insert pipe, enters the pig iron production unit at an oxygen gas entry velocity, and an interspace which is present between the outer wall of the injector insert pipe and the wall of the gas channel is simultaneously flowed through by a gas which, after it has flowed through the interspace, exits into the pig iron production unit at a gas exit velocity, wherein the oxygen gas entry velocity is greater than the gas exit velocity.

When carrying out the process according to various embodiments by means of the device according to various embodiments, the oxygen-containing gas which enters the pig iron production unit from the injector insert pipe is enveloped by a jacket of gas which flows at a relatively low velocity. Since the gas which exits into the pig iron production unit at the gas exit velocity is slower, reduced quantities of media are sucked up from the reaction chamber of the pig iron production unit and reduced quantities of such media flow back in the direction of the nozzle. The wear brought about by such backflows and deposits on the nozzle and in the gas channel are accordingly reduced, and the service life of the nozzle is increased. The nozzle is preferably produced from copper or from a copper alloy in order to ensure good dissipation of heat as it is cooled.

The nozzle may have one or more gas channels through which gases can be supplied to the pig iron production unit. In the device according to various embodiments, an injector insert pipe is arranged in at least one of these gas channels. The injector insert pipe can preferably be inserted into the gas channel in exchangeable fashion. The advantage of this is that an injector insert pipe affected by wear can easily be exchanged. Here, "can be inserted in exchangeable fashion" is to be understood as meaning a type of insertion in which either no fixed connection is formed between the injector insert pipe and the gas channel, or a connection is formed between the insert piece and the gas channel which can be released without affecting the structure of the nozzle. A type of connection of this nature which can be released without affecting the structure of the nozzle is, for example, adhesive bonding or screwing.

A type of insertion in which no fixed connection is formed between the injector insert pipe and the gas channel is, for example, pushing in. A type of insertion in which no fixed connection is formed between the injector insert pipe and the gas channel is preferred. By way of example, a type of insertion of this nature is achieved in that, if the diameter of the gas channel dramatically tapers continuously or in portions in the direction of the reaction chamber, the outer contour of the injector insert pipe follows the inner contour of the gas channel and is held in position by the pressure of the oxygen-containing gas which is flowing, but not by a connection between the injector insert pipe and the gas channel.

The injector insert pipe is arranged in the gas channel in such a way that an interspace is present between the outer wall of said injector insert pipe and the wall of the gas channel. The interspace surrounds the injector insert pipe over its entire length. This has the effect that gas introduced into the interspace can cool the injector insert pipe over its entire length.

In order to hold the inserted injector insert pipe in position, it is provided with spacers which support said pipe on the wall of the gas channel. The spacers are preferably as thin and narrow as possible in order not to hinder the flow of the gas which is introduced in the interspace between the outer wall of the injector insert pipe and the wall of the gas channel.

According to one embodiment, a plurality of injector insert pipes are arranged in a gas channel, wherein a further injector insert pipe with a relatively small diameter is arranged within a respective first injector insert pipe. An annular gap is formed between the walls of these two injector insert pipes. Different media can be passed through each of these annular gaps between two injector insert pipes. The statements made with respect to the fastening of an injector insert pipe in the gas channel apply correspondingly to the fastening of the injector insert pipes inside one another.

The injector insert pipe is produced from refractory material which has high mechanical strength, dimensional stability, wear resistance and corrosion resistance and is tolerant to a high permissible operating temperature. This reduces the susceptibility of the injector insert pipe to wear under operating conditions. By way of example, the refractory material is aluminum oxide $Al_2O_3$, zirconium dioxide $ZrO_2$, magnesium oxide MgO, non-oxidic ceramic fiber composite materials such as, for example, those consisting of silicon carbide SiC and fibers of carbon C, or oxidic ceramic fiber composite materials such as sheet ceramic, for example fibers of $Al_2O_3$ with binders of $SiO_2$ or $ZrO_2$ or $Al_2O_3$. Here, the term "refractory material" also includes high-temperature-resistant steels.

The preferred refractory material is sheet ceramic. A sheet ceramic with fibers of 99.9% by mass $Al_2O_3$ (remainder impurities) and a matrix of 93% by mass $Al_2O_3$ and 7% by mass zirconium dioxide, which is stabilized by 8 mol % yttrium oxide, has a flexural strength according to DIN EN 843-1 [N/mm$^2$] at RT of 160-170, a tensile strength according to DIN V ENV 1892 [N/mm$^2$] at 1000° C. of 35, and a modulus of elasticity according to DIN EN 843-2 [N/mm$^2$] at RT of 50 000.

The injector insert pipe extends at least as far as the mouth of the gas channel into the reaction chamber of the pig iron production unit. This ensures that the streams of gas flowing out of the injector insert pipe and out of the interspace are not already mixed within the gas channel. The effect of the enveloping of the oxygen-containing gas which flows relatively quickly by the gas which flows relatively slowly in the reaction chamber of the pig iron production unit is therefore particularly pronounced, and backflows are effectively prevented. Oxygen-containing gas can be supplied to the injector insert pipe by connecting the space surrounded by the injector insert pipe to a feed line for oxygen-containing gas. The gas which flows in the interspace present between the outer wall of the injector insert pipe and the wall of the gas channel may be a protective gas such as, for example, an inert gas, for instance nitrogen or argon, or steam, natural gas, a gas which is present in the pig iron production unit, a mixture of different protective gases, or oxygen-containing gas. Argon or nitrogen is used with preference as the protective gas.

Gas of this type can be supplied to the interspace by connecting this interspace to a supply line for protective gas or to a supply line for oxygen-containing gas.

Substances, for example granules, oils or dust, may also be blown into the reaction chamber of the pig iron production unit together with the protective gas. This makes it possible to supply substances which are desirable for the production of pig iron into the reaction chamber, or to discharge waste materials.

The lower the temperature of the gas which flows in the interspace present between the outer wall of the injector insert pipe and the wall of the gas channel, the greater its cooling action on the nozzle and on the injector insert pipe. This cooling action contributes to the reduction of thermally induced wear.

When carrying out the process according to various embodiments, the oxygen gas entry velocity is between 70 and 330 m/s, preferably between 170 and 220 m/s. The gas exit velocity is between 20 and 60 m/s. If this velocity is less than 20 m/s, it is not possible to overcome the pressure which prevails in the pig iron production unit. If this velocity is more than 60 m/s, so much protective gas will be fed into the pig iron production unit that the processes occurring in the pig iron production unit will be influenced noticeably. The pig iron production unit may be a melter gasifier or a blast furnace. A preferred use according to various embodiments is in a melter gasifier.

According to one embodiment, the injector insert pipe extends beyond the end face of the nozzle which contains the mouth of the gas channel. As a result, the oxygen-containing gas which enters the pig iron production unit is concentrated for a longer period of time, and can therefore penetrate more directionally and further into the reaction chamber. This results in improved utilization of the oxygen-containing gas for the reactions which occur in the reaction chamber of the pig iron production unit.

According to an embodiment, the gas channel is provided, in the region of the mouth, with one or more insert pieces which are made from refractory material and extend at least as far as the end face of the nozzle which contains the mouth of the oxygen channel, with the outlet edge also being included. Materials suitable for the refractory material of an insert piece are the same as those specified for the refractory material of the injector insert pipe. Here, "region of the mouth of the gas channel" is understood as meaning that 10% of the longitudinal extent of the gas channel which protrudes from the outlet edge. It has been shown that a principal problem when the nozzle becomes worn is the thermal-abrasive wear on the outlet edge of the mouth. Once the outlet edge starts to become worn, the wear progresses quicker and further since wear-induced rounding of the outlet edge firstly entails reduced cooling of the outlet edge by the injected oxygen and secondly brings about a strengthened suction action and an associated temperature increase in the problem zone affected by wear. The advantage of providing the mouth with resistant insert pieces is that the risk of wear problems progressing on the outlet edge of the mouth is reduced. By way of example, an insert piece may be cylindrical.

If the insert piece extends beyond the end face of the nozzle which contains the mouth of the oxygen channel, the outlet edge is protected particularly effectively against wear. In addition, the gas which enters the pig iron production unit is concentrated for a longer period of time, and this reduces the risk of the occurrence of wear-promoting suction and backflows of media from the reaction chamber.

According to an embodiment, the end face of the nozzle which contains the mouth of the gas channel is provided with one or more insert pieces made from refractory material, wherein the outlet edge of the mouth is completely covered. Materials suitable for the refractory material of an insert piece of this type are the same as those specified for the refractory material of the injector insert pipe. The advantage of providing the end face, together with the outlet edge, with resistant insert pieces is that the risk of wear problems progressing on the outlet edge of the mouth and on the end face is reduced. By way of example, an insert piece may be disk-shaped.

The use of the nozzle or the injector insert pipe according to various embodiments affords the advantage, with respect to the prior art, that the service life of the nozzle is increased, without making maintenance more difficult or complicating production.

It is advantageously possible to provide existing nozzles with injector insert pipes according to various embodiments, which are matched to the shape of the gas channel. It may be necessary to modify the nozzles for this purpose.

FIG. 1 shows an excerpt of a region of the wall 1 of a pig iron production unit. A sleeve 2, which extends into the interior of the pig iron production unit, is fitted to the wall 1 of the pig iron production unit. A nozzle 4 is inserted at that end of the sleeve 2 which faces toward the interior of the pig iron production unit. Both the sleeve 2 and the nozzle 4 have cooling channels 3*a*, 3*b*, in which water circulates. Effective heat dissipation is ensured by producing the nozzle 4 from a copper alloy. A gas channel passes through the length of the nozzle 4. An injector insert pipe 5, which is made from refractory material and extends as far as the end face of the nozzle 4 which contains the mouth of the gas channel, is inserted into the gas channel of the nozzle 4 in exchangeable fashion.

A feed line 6 for oxygen-containing gas passes through an opening in the wall 1 of the pig iron production unit and through the sleeve 2. This feed line 6 for oxygen-containing gas is connected to the space surrounded by the injector insert pipe 5. The oxygen-containing gas flowing through the feed line 6 and the injector insert pipe 5 is illustrated by straight arrows. The interspace 7 present between the outer wall of the injector insert pipe 5 and the wall of the gas channel is connected to a supply line 8 for protective gas. The protective gas flowing through the supply line 8 and the interspace 7 is illustrated by wavy arrows. An intermediate piece 13 is used to connect the feed line 6 to the space surrounded by the injector insert pipe 5 and to connect the interspace 7 present between the outer wall of the injector insert pipe 5 and the wall of the gas channel to the supply line 8.

The supply line 8 for protective gas passes through an opening in the wall 1 of the pig iron production unit and the sleeve 2. The oxygen-containing gas leaves the injector insert pipe 5 and enters the reaction chamber 9 in the interior of the pig iron production unit. In the process, it is enveloped by the protective gas which exits from the interspace 7. In this case, the oxygen gas entry velocity is greater than the gas exit velocity. In order to hold the inserted injector insert pipe 5 in position, it is provided with spacers 10 which support said pipe on the wall of the gas channel.

Figure 2:
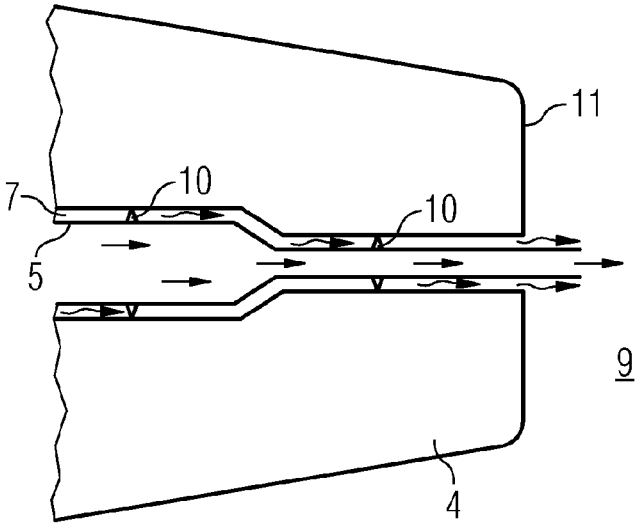
FIG. 2 shows a longitudinal section of an excerpt of a nozzle for an embodiment.

FIG. 2 shows an excerpt of a nozzle 4 for an embodiment, in which an injector insert pipe 5 is inserted into the gas channel of a copper nozzle 4. The shape of the injector insert pipe 5 is optimally matched in fluidic terms to the shape of the gas channel; the inner and outer contour of this pipe follow the contour of the gas channel. As a result, the fluidic effects which should be achieved by the shape of the gas channel also occur when the injector insert pipe is flowed through.

Spacers 10 which afford little flow resistance support the injector insert pipe 5 on the inner wall of the gas channel. The reaction chamber 9 of the pig iron production unit is positioned to the right of the nozzle 4. The injector insert pipe 5 extends beyond the end face 11 of the nozzle which contains the mouth of the gas channel into the reaction chamber, and therefore projects into the reaction chamber. Oxygen flows into the reaction chamber 9 through the injector insert pipe 5. Protective gas, which is illustrated by wavy arrows, flows into the reaction chamber through the interspace 7 present between the outer wall of the injector insert pipe and the wall of the gas channel. This protective gas, which exits into the pig iron production unit at a low gas exit velocity, envelops the stream of oxygen, which enters the pig iron production unit from the injector insert pipe 5 and is illustrated by straight arrows, and cools the nozzle 4 and the injector insert pipe 5.

Figure 3:
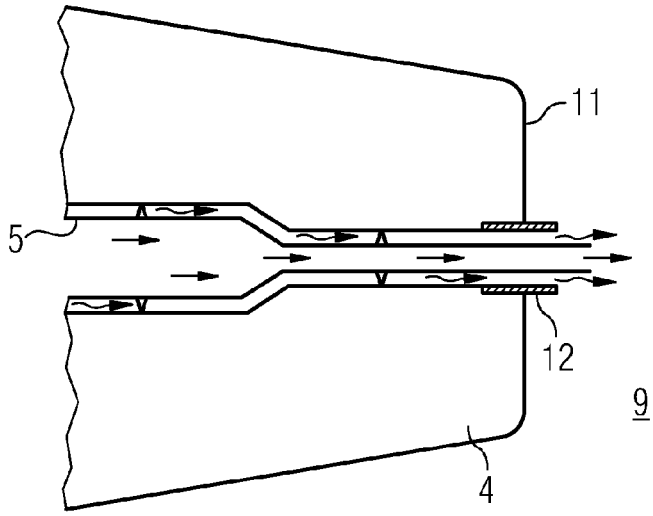
FIG. 3 shows a longitudinal section of an excerpt of a nozzle for a further embodiment.

FIG. 3 largely corresponds to FIG. 2, with the difference that the gas channel is provided, in the mouth region, with a cylindrical insert piece 12 which is made from refractory material and protects the outlet edge of the gas channel against wear.

Figure 4:
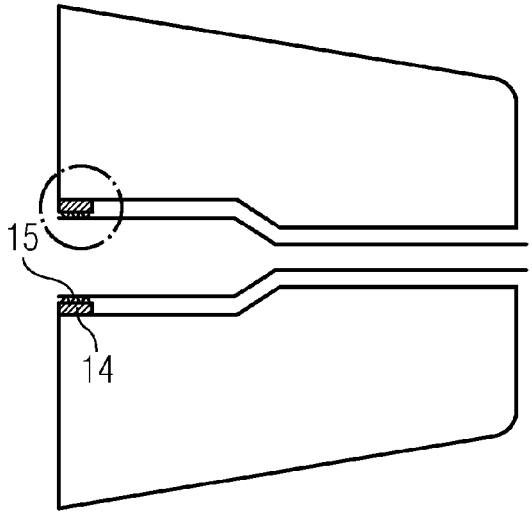
FIGS. 4 and 5 show a longitudinal section of variants of the connection between the injector insert pipe and the gas channel of a nozzle.
Figure 5:
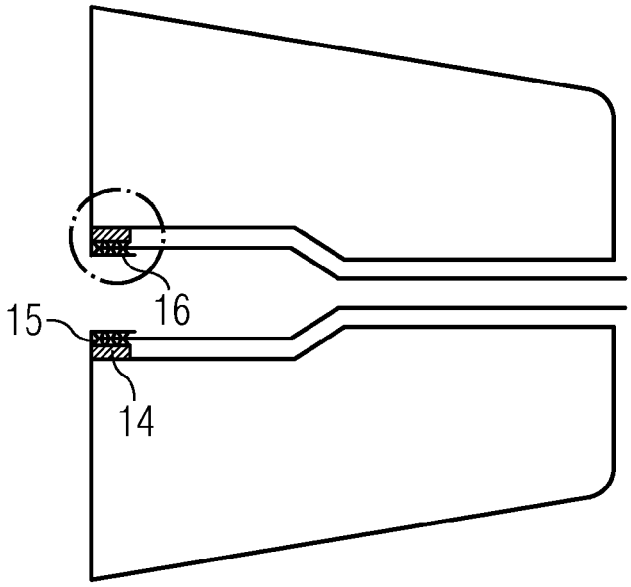

FIGS. 4 and 5 show variants of the connection between the injector insert pipe 5 and the gas channel of a nozzle 4.

Figure 4A:
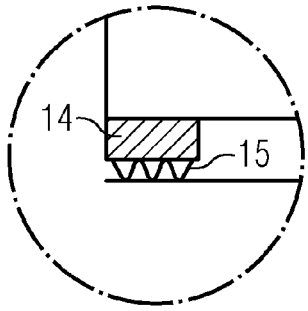

FIG. 4 shows how the injector insert pipe 5 is adhesively bonded to a spacer ring 14 fastened in the gas channel. The adhesive bond 15 is illustrated by a wavy line. FIG. 4*a* shows an enlarged image of that region of the bond which is circled by dashed lines in FIG. 4.

Figure 5A:
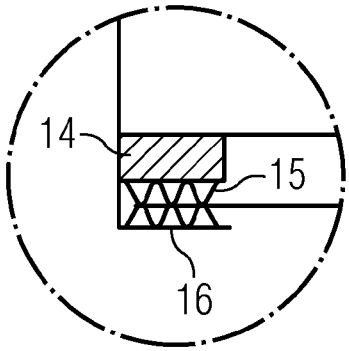

FIG. 5 shows how the injector insert pipe 5 is inserted into a groove 16 of a spacer ring 14 fastened in the gas channel and additionally adhesively bonded to the spacer ring 14 by an adhesive bond 15. FIG. 5*a* shows an enlarged image of that region of the bond which is circled by dashed lines in FIG. 5.

The injector insert pipe does not have to extend over the entire length of the gas channel. It is merely important that it extends at least as far as the end face of the nozzle which contains the mouth of the gas channel into the reaction chamber. Accordingly, the injector insert pipe may also extend only over part of the length of the gas channel. It is easier and less expensive to produce a shorter injector insert pipe. The feed line for oxygen-containing gas and the supply line for protective gas or the supply line for oxygen-containing gas should then be extended as far as the injector insert pipe into the gas channel.

Figure 6:
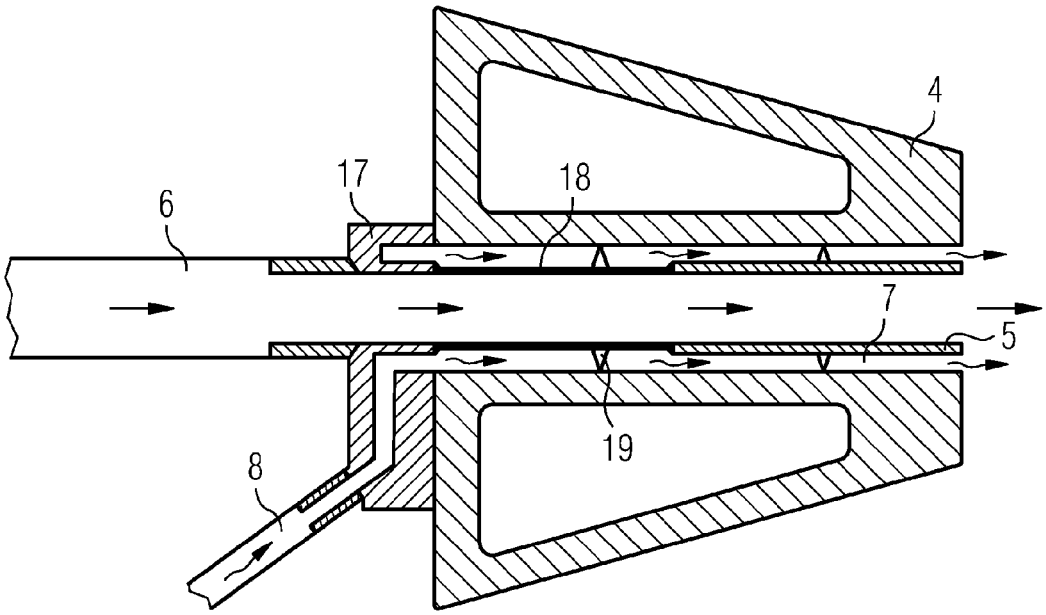
FIG. 6 shows a longitudinal section of an embodiment, in which the injector insert pipe extends only over part of the length of the gas channel.

FIG. 6 shows an embodiment, in which the injector insert pipe 5 does not extend over the entire length of the gas channel of the nozzle 4. An intermediate piece 17, from which an extension pipe 18 extends into the gas channel, is used to connect the feed line 6 to the space surrounded by the injector insert pipe 5 and to connect the interspace 7 present between the outer wall of the injector insert pipe 5 and the wall of the gas channel to the supply line 8. Spacers 19 support the extension pipe 18 on the wall of the gas channel. The injector insert pipe 5 is fastened to the end of the extension pipe 18.

The injector insert pipe can be fastened to the extension pipe in one of the ways mentioned for connecting the gas channel to the injector insert pipe. By way of example, the end of the extension pipe may be provided with a groove into which the injector insert pipe is inserted, said groove additionally being provided with an adhesive bond, for example.

1 Wall (of a pig iron production unit)
2 Sleeve
3 Cooling channel
4 Nozzle
5 Injector insert pipe
6 Feed line for oxygen-containing gas
7 Interspace (present between the outer wall of the injector insert pipe 5 and the wall of the gas channel)
8 Supply line for protective gas
9 Reaction chamber

10 Spacer
11 End face
12 Cylindrical insert piece
13 Intermediate piece
14 Spacer ring
15 Adhesive bond
16 Groove
17 Intermediate piece
18 Extension pipe
19 Spacer

What is claimed is:

1. A nozzle for injecting oxygen-containing gas into a pig iron production unit, comprising at least one gas channel, wherein an injector insert pipe, which can be inserted into the gas channel of the nozzle in exchangeable fashion, is arranged in the gas channel of the nozzle in such a way that an interspace which surrounds the injector insert pipe is present over the entire length of the injector insert pipe between a wall of the gas channel and an outer wall of the injector insert pipe, the injector insert pipe is provided with spacers which support said pipe, when it has been inserted, on the wall of the gas channel, the injector insert pipe is produced from refractory material, the injector insert pipe extends at least as far as an end face of the nozzle which contains a mouth of the gas channel, a space surrounded by the injector insert pipe is connected to a feed line for oxygen-containing gas, and wherein an interspace between the wall of the as channel and the outer wall of the injector insert pipe is connected to a supply line for protective gas;

wherein the end face of the nozzle which contains the mouth of the gas channel is provided with one or more insert pieces made from refractory material, wherein an outlet edge of the mouth is completely covered.

2. The nozzle according to claim 1, wherein the pig iron production unit is a melter gasifier.

3. The nozzle according to claim 1, wherein the refractory material is aluminum oxide $Al_2O_3$, zirconium dioxide $ZrO_2$, magnesium oxide MgO, non-oxidic ceramic fiber composite materials, oxidic ceramic fiber composite materials or high-temperature-resistant steels.

4. A nozzle for injecting oxygen-containing gas into a pig iron production unit, comprising at least one gas channel, wherein an injector insert pipe, which can be inserted into the gas channel of the nozzle in exchangeable fashion, is arranged in the gas channel of the nozzle in such a way that an interspace which surrounds the injector insert pipe is present over the entire length of the injector insert pipe between a wall of the gas channel and an outer wall of the injector insert pipe, the injector insert pipe is provided with spacers which support said pipe, when it has been inserted, on the wall of the gas channel, the injector insert pipe is produced from refractory material, the injector insert pipe extends at least as far as an end face of the nozzle which contains a mouth of the gas channel, a space surrounded by the injector insert pipe is connected to a feed line for oxygen-containing gas, and wherein an interspace between the wall of the gas channel and the outer wall of the injector insert pipe is connected to a supply line for protective gas;

wherein the injector insert pipe extends beyond the end face of the nozzle which contains the mouth of the gas channel.

5. A nozzle for injecting oxygen-containing gas into a pig iron production unit, comprising at least one gas channel, wherein an injector insert pipe, which can be inserted into the gas channel of the nozzle in exchangeable fashion, is arranged in the gas channel of the nozzle in such a way that an interspace which surrounds the injector insert pipe is present over the entire length of the injector insert pipe between a wall of the gas channel and an outer wall of the injector insert pipe, the injector insert pipe is provided with spacers which support said pipe, when it has been inserted, on the wall of the gas channel, the injector insert pipe is produced from refractory material, the injector insert pipe extends at least as far as an end face of the nozzle which contains a mouth of the gas channel, a space surrounded by the injector insert pipe is connected to a feed line for oxygen-containing gas, and wherein an interspace between the wall of the gas channel and the outer wall of the injector insert pipe is connected to a supply line for protective gas;

wherein the gas channel is provided, in the region of the mouth, with one or more insert pieces which are made from refractory material and extend at least as far as the end face of the nozzle which contains the mouth of the oxygen channel.

* * * * *